US011695191B2

(12) United States Patent
Tessier et al.

(10) Patent No.: US 11,695,191 B2
(45) Date of Patent: Jul. 4, 2023

(54) DUAL-BAND POLARISER

(71) Applicant: Nokia Shanghai Bell Co., Ltd., Shanghai (CN)

(72) Inventors: Julien Tessier, Saint-Herblain (FR); Guillaume Prot, La Baule (FR); Denis Tuau, Trignac (FR)

(73) Assignee: Nokia Shanghai Bell Co., Ltd, Shanghai (CN)

( * ) Notice: Subject to any disclaimer, the term of this patent is extended or adjusted under 35 U.S.C. 154(b) by 0 days.

(21) Appl. No.: 17/050,951

(22) PCT Filed: Apr. 26, 2019

(86) PCT No.: PCT/CN2019/084679
§ 371 (c)(1),
(2) Date: Oct. 27, 2020

(87) PCT Pub. No.: WO2019/206306
PCT Pub. Date: Oct. 31, 2019

(65) Prior Publication Data

US 2021/0234281 A1 Jul. 29, 2021

(30) Foreign Application Priority Data

Apr. 27, 2018 (EP) ..... 18169978

(51) Int. Cl.
*H01P 1/161* (2006.01)
*H01Q 5/47* (2015.01)
(Continued)

(52) U.S. Cl.
CPC ..... *H01P 1/161* (2013.01); *H01P 1/065* (2013.01); *H01P 1/165* (2013.01); *H01P 1/171* (2013.01);
(Continued)

(58) Field of Classification Search
CPC ..... H01P 1/161; H01P 1/065; H01P 1/165; H01P 1/171; H01Q 5/47; H01Q 15/16; H01Q 19/193
See application file for complete search history.

(56) References Cited

U.S. PATENT DOCUMENTS 4,740,795 A 4/1988 Seavey
5,075,649 A * 12/1991 Pellegrineschi ..... H01P 1/161 342/361
(Continued)

FOREIGN PATENT DOCUMENTS

CN 1479951 A 3/2004
CN 101872902 A 10/2010
(Continued)

OTHER PUBLICATIONS

International Search Report—PCT/CN2019/084679 dated Jul. 25, 2019.

*Primary Examiner* — Hafizur Rahman
*Assistant Examiner* — Kimberly E Glenn
(74) *Attorney, Agent, or Firm* — Lippes Mathias LLP

(57) ABSTRACT

Apparatus for dual-band antenna and communications tower comprising such apparatus are provided. The apparatus comprises a first part (202) comprising first and second propagation paths configured to selectively propagate signals of a first frequency with either a first polarization state or a second polarization state, a transition part (204) rotatable between first and second transition positions to selectively propagate signals of a second frequency along the second signal path with the first polarisation state when in the first transition position and with the second polarisation state when in the second transition position and a rotator part rotatable between first and second rotator positions. Wherein, the rotator part is configured to orientate the polarisation of signals in the second signal path in order to
(Continued)

couple the second signal path to an interface, and allow propagation of signals in the first signal path in either the first or second rotator positions.

10 Claims, 17 Drawing Sheets

(51) Int. Cl.

| | |
|---|---|
| ***H01P 1/17*** | (2006.01) |
| ***H01Q 15/16*** | (2006.01) |
| ***H01Q 19/19*** | (2006.01) |
| ***H01P 1/165*** | (2006.01) |
| ***H01P 1/06*** | (2006.01) |

(52) U.S. Cl.
CPC ..... *H01Q 5/47* (2015.01); *H01Q 15/16* (2013.01); *H01Q 19/193* (2013.01)

(56) References Cited

U.S. PATENT DOCUMENTS

| | | | | |
|---|---|---|---|---|
| 5,576,668 | A * | 11/1996 | Clark | H01P 1/173 333/159 |
| 6,853,343 | B2 | 2/2005 | McCandless et al. | |
| 10,236,575 | B2 * | 3/2019 | Lundstedt | H01Q 15/16 |
| 2013/0141300 | A1 | 6/2013 | Runyon et al. | |
| 2015/0015440 | A1 | 1/2015 | Montgomery | |

FOREIGN PATENT DOCUMENTS

| | | | |
|---|---|---|---|
| CN | 104011934 | A | 8/2014 |
| CN | 105206936 | A | 12/2015 |
| CN | 105470649 | A | 4/2016 |
| CN | 105896088 | A | 8/2016 |
| EP | 0 812 029 | A1 | 12/1997 |
| JP | H056901 | A | 1/1993 |
| JP | 2005101744 | A | 4/2005 |
| WO | WO 95/01661 | A1 | 1/1995 |
| WO | WO 99/10950 | A2 | 3/1999 |
| WO | WO 2018/057824 | | 3/2018 |
| WO | WO-2021188171 | A1 * | 9/2021 |

* cited by examiner

DUAL-BAND POLARISER

FIELD

Various embodiments and examples relate to polarisers for dual-band antennas.

BACKGROUND

Conventional wireless transport is mainly provided by microwave parabolic antenna systems. These antennas operate in each frequency band defined by the ITU and ETSI or FCC regulation in a single or a dual polarization configuration. Microwave backhaul antenna solutions intended for Band and Carrier Aggregation are addressed by using two separate microwave antennas operating individually in two distinct frequency bands. In this case, the polarizations are independently selected on each antenna.

Modern communication applications can require high data rate communications of up to 10 Gbps, such as video streaming, mobile TV and other smart phone applications. These applications provide a challenge to current wireless transport systems where each antenna operates in a single frequency band.

SUMMARY

According to a first aspect, this specification describes an apparatus comprising: a first part comprising first and second propagation paths configured to selectively propagate signals with either a first polarisation state or a second polarisation state, the first part being rotatable between a first feed position in which the first propagation path is disposed within a first signal path and a second feed position in which the second propagation path is disposed within the first signal path, and wherein the first part is configured to allow propagation of signals in a second signal path in either the first or second feed positions. The apparatus further comprises a transition part rotatable between first and second transition positions, wherein the transition part is configured to selectively propagate signals of the second frequency along the second signal path with the first polarisation state when in the first transition position and with the second polarisation state when in the second transition position, wherein the transition part is configured to allow propagation of signals in the first signal path in either the first or second transition positions. The apparatus further comprises a rotator part rotatable between first and second rotator positions, the rotator part being configured to orientate the polarisation of signals in the second signal path in order to couple the second signal path to an interface, wherein the rotator part is configured to allow propagation of signals in the first signal path in either the first or second rotator positions. The device may be for a dual-band microwave antenna and be configured to select polarisations of microwave signals of a first frequency propagating along a first signal path and microwave signals of a second frequency propagating along a second signal path.

The first part and second part may be coaxial and the second signal path may be oriented along an axial path. The first signal path may be offset from the axial path.

The first and second polarisation states may be orthogonal relative to one another.

The first feed position and second feed position are at an angle of 180 degrees relative to one another.

The first transition position and the second transition position are at an angle of 90 degrees relative to one another.

The first rotator position and the second rotator position may be at an angle of 135 degrees relative to one another.

The first part may comprise an orthomode transducer.

The first part may comprise one or more mounting pins, and wherein the transition part is configured to be mounted on the one or more pins.

The first part may comprise one or more labels indicative of a polarisation setting and wherein the transition part further comprises one or more openings arranged to align with at least one of the labels.

The transition part may further comprise one or more alignment markings for orienting the transition part relative to the first part.

According to a further aspect, this specification describes a system comprising an apparatus according to the first aspect; a first radio unit configured to transmit and/or receive microwave signals at the first frequency; a second radio unit configured to transmit and/or receive microwave signals at the second frequency different to the first frequency; and a waveguide element operable to couple the second radio unit to the second signal path via the interface, and the first signal path to the first radio unit via a further interface.

The system may further comprise a reflector coupled to the first and second signal paths.

According to a further aspect, this specification describes A communications tower comprising: the apparatus of the first aspect; a first radio unit configured to transmit and/or receive microwave signals at the first frequency; a second radio unit configured to transmit and/or receive microwave signals at the second frequency different to the first frequency; and a waveguide element operable to couple the second radio unit to the second signal path via the interface, and the first signal path to the first radio unit via a further interface.

The communications tower may further comprise a reflector coupled to the first and second signal paths.

It will be understood that the systems described herein can act to receive and/or transmit electromagnetic signals, such as radio and/or microwave signals. As such, references to transmission of signals can be taken to refer to receipt of signals where appropriate, and vice versa. For convenience, embodiments will be described in relation to transmitting signals, though can equally apply to receiving signals.

For convenience and clarity, example embodiments will often be described in relation to linear polarisations of transmitted and received signals. However, it will be understood that the embodiments could equally apply to circular and/or elliptical polarisations.

BRIEF DESCRIPTION OF DRAWINGS

For a more complete understanding of the apparatuses and methods described herein, reference is now made to the following drawings in which.

DETAILED DESCRIPTION

Figure 1A:
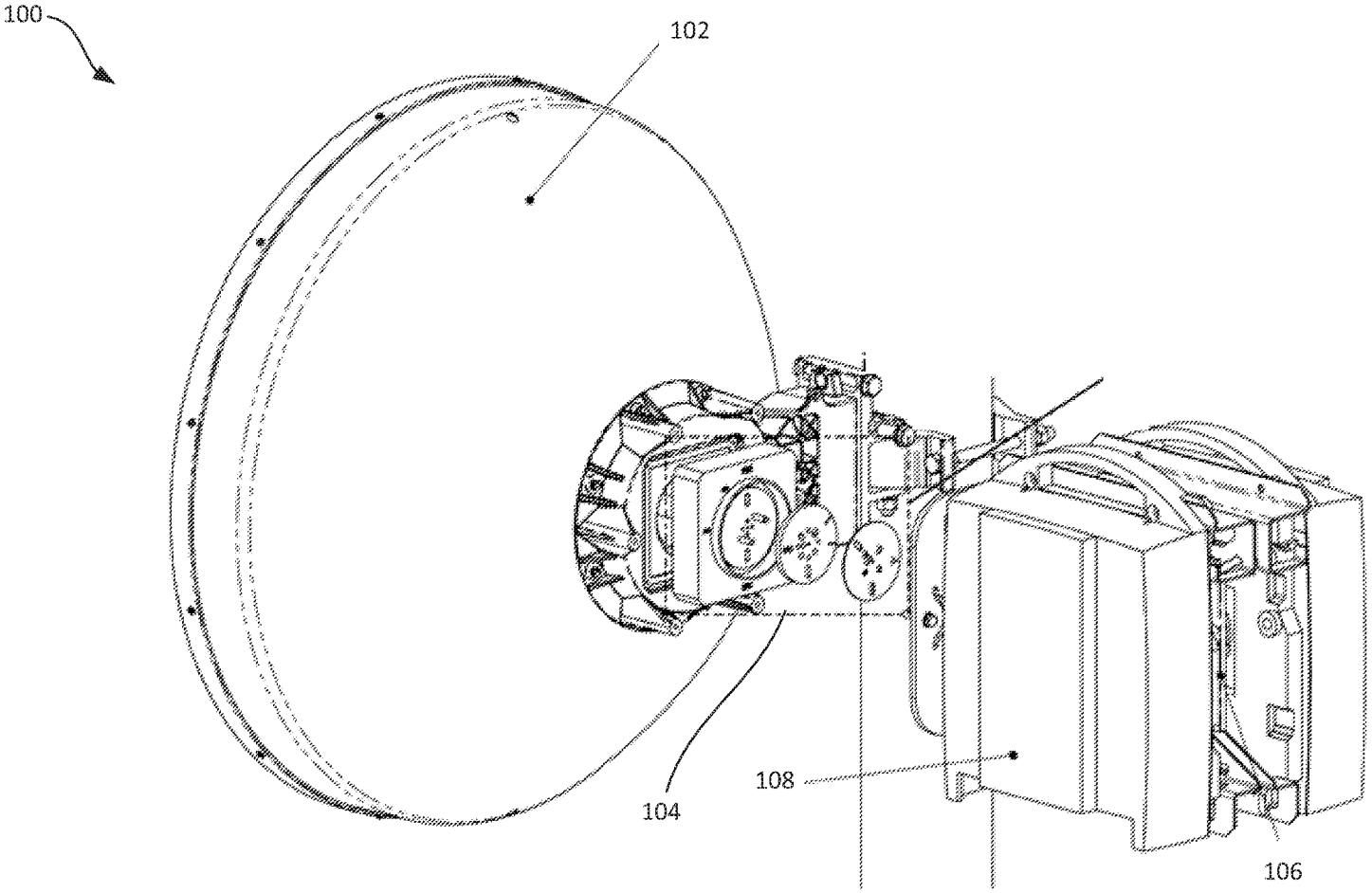
FIGS. 1*a* and 1*b* show disassembled views of an example embodiment of a microwave antenna system comprising a polarisation device.
Figure 1B:
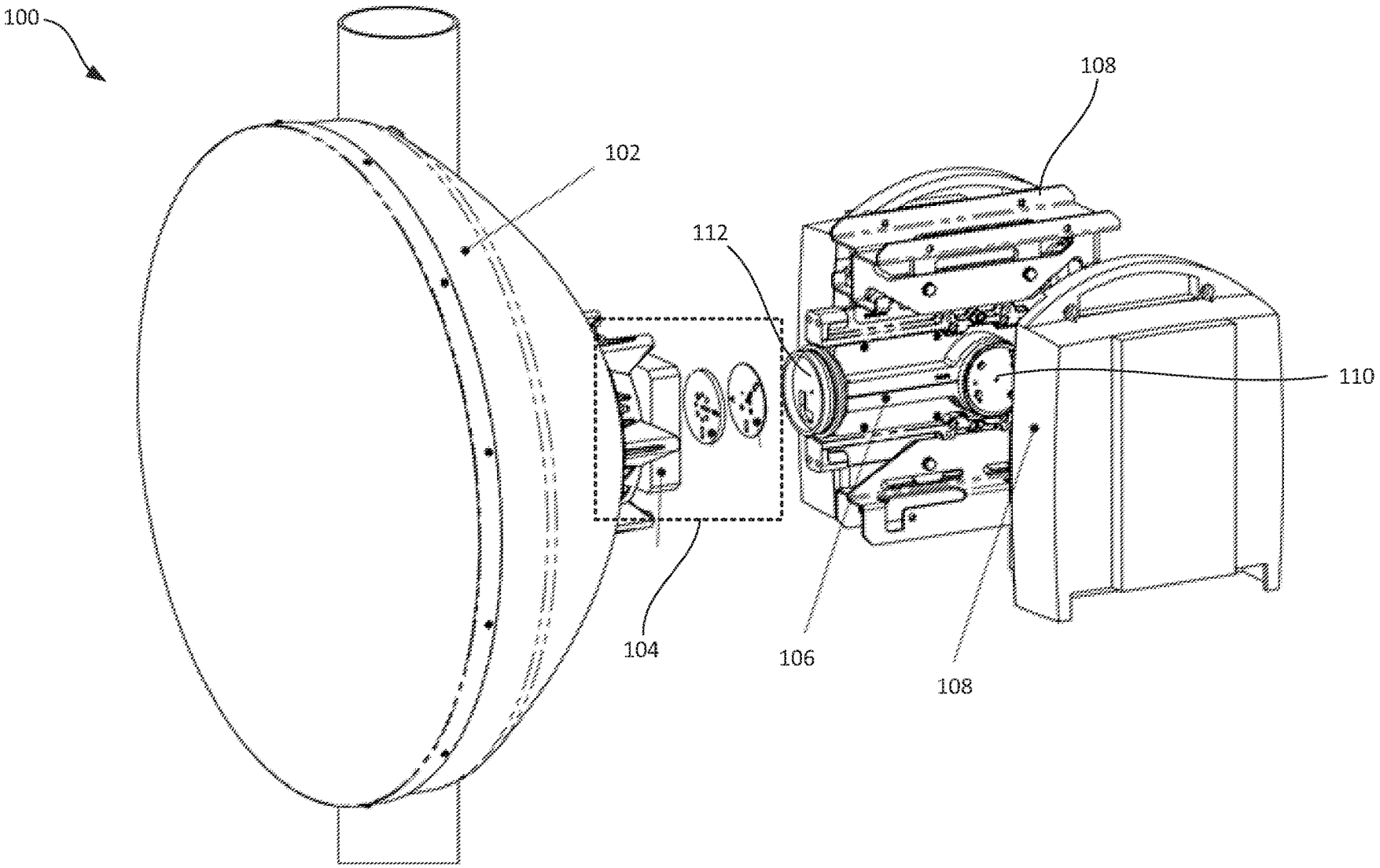

FIGS. 1*a* and 1*b* show an example embodiment of a system comprising an antenna with a polariser device. The antenna may be a radio and/or microwave antenna. The system 100 comprises a reflector 102, a polariser device 104, a branch box 106 and at least two outdoor units (ODU) 108. In the example shown, the system 100 is a dual-band microwave antenna, with two outdoor units 108. The outdoor units 108 may be connected to an indoor unit (IDU, not shown) via an intermediate frequency cable (IF cable, not shown). While the polariser has been described with reference to outdoor units, it will be appreciated that it can be used with other types of radio unit. For example, the polariser device also can be used in radio and/or microwave antennas that are located indoors. In some embodiments, the system is mounted on and/or comprises a part of a radio communications tower.

The reflector 102 (also referred to herein as an antenna) acts to direct signals, such as radiofrequency signals in the microwave spectrum, in a direction. It also acts to receive signals. The reflector may be a parabolic dish.

The polariser device 104 is described in more detail below in relation to FIGS. 2 to 7.

The branch box 106 comprises a plurality of waveguides (not shown), a plurality of outdoor unit interfaces 110, each for receiving input signals from an outdoor unit 108 to a waveguide and/or transmitting signals from the waveguide to an outdoor unit. The branch box 106 further comprises a polariser interface 112 for connecting the waveguides to the polariser device 104.

Figure 9A:
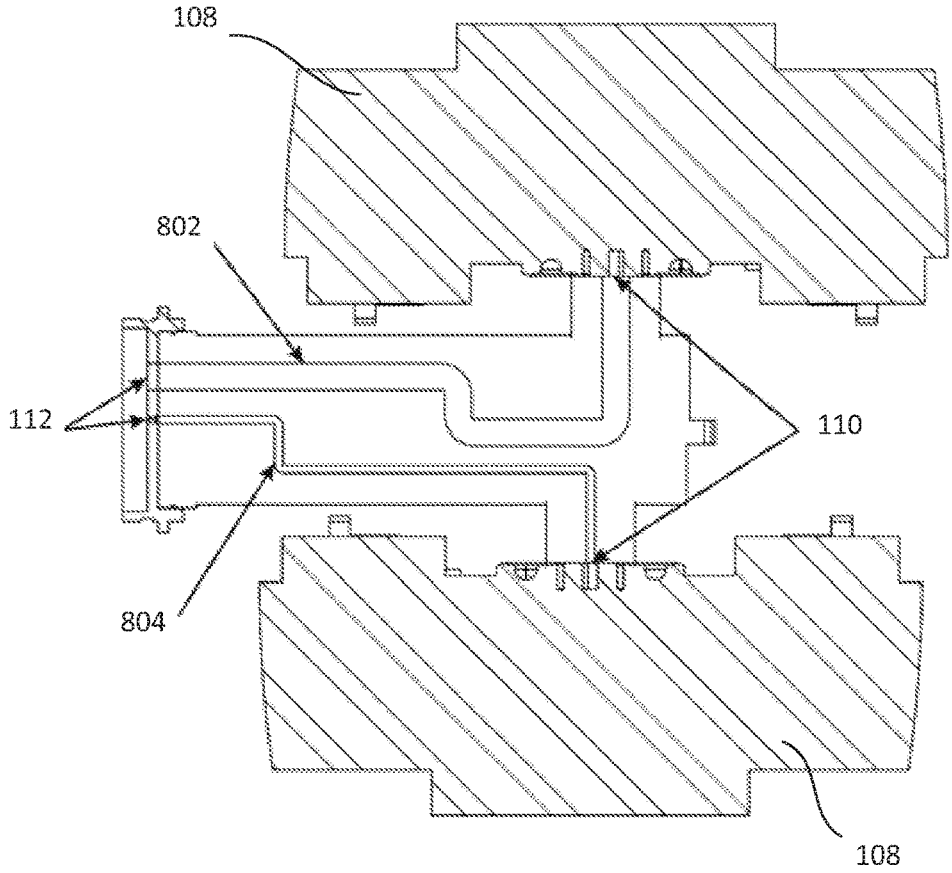
FIGS. 9*a-b* shows a plan view of an example embodiment of a branch box.
Figure 9B:
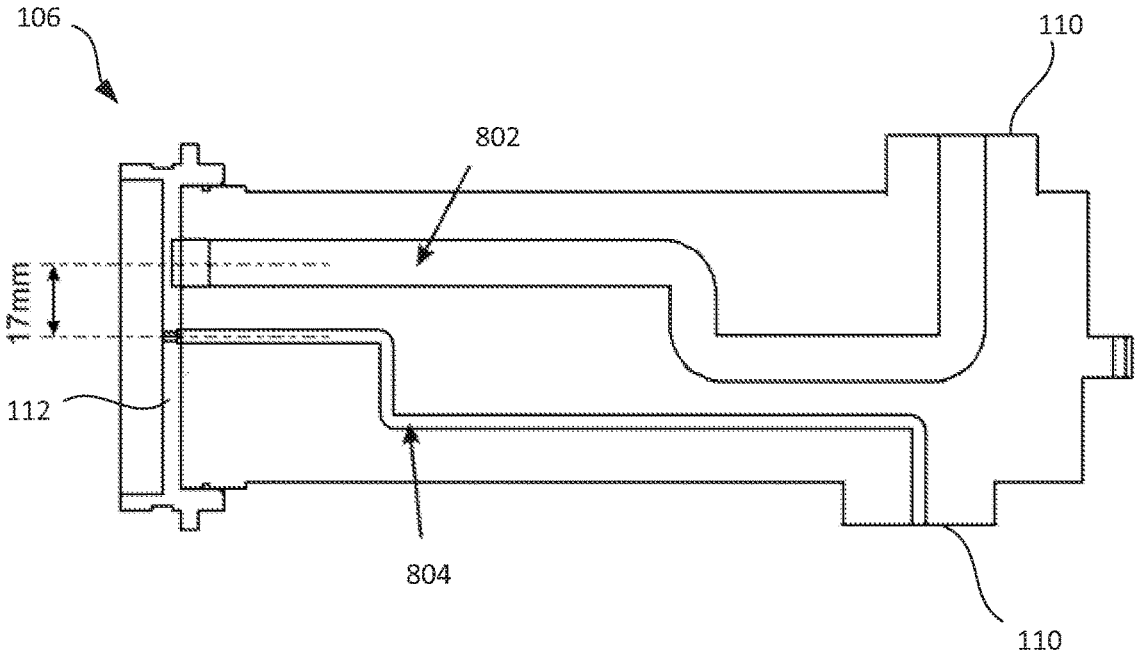
Figure 10:
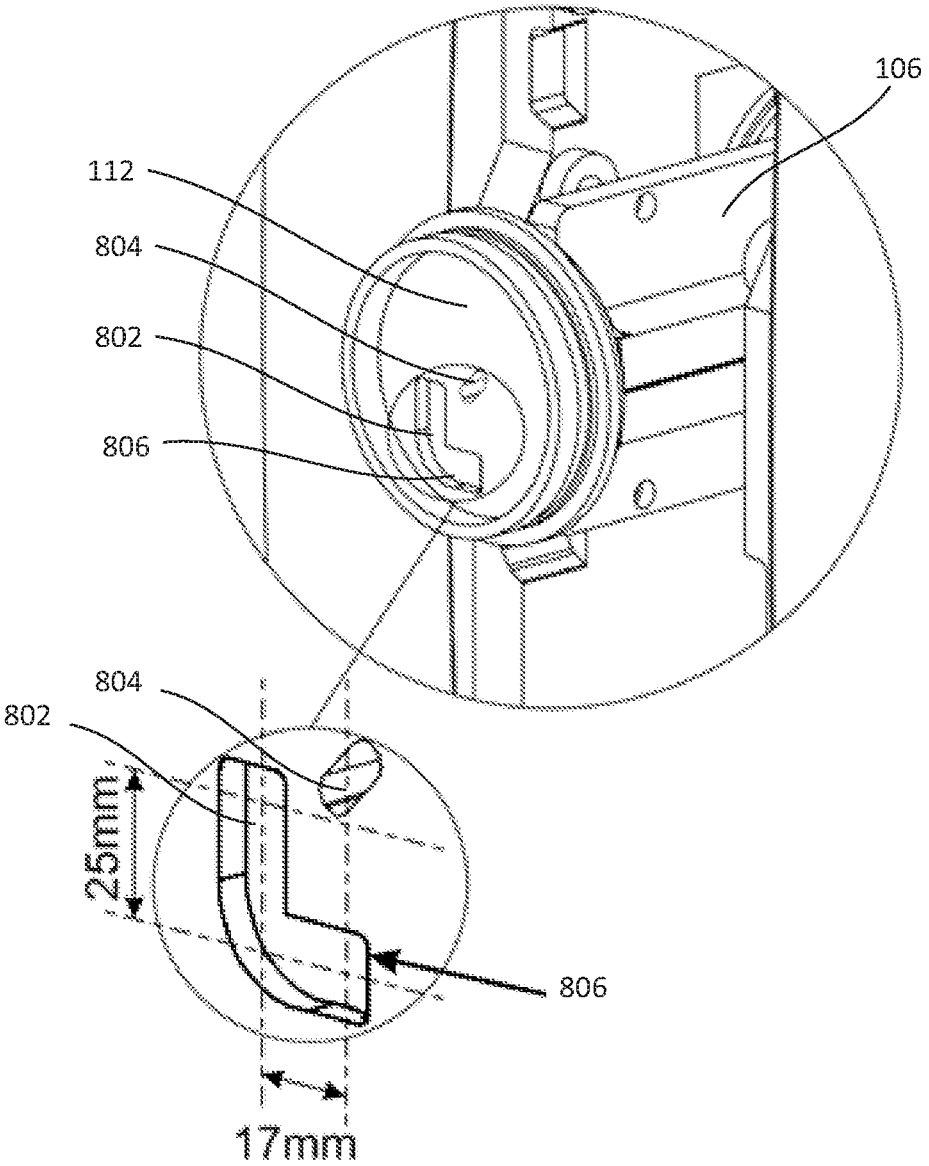
FIG. 10 shows a close-up view of an example embodiment of a polariser interface of a branch box.

Examples of the branching box will be described in further detail below, with reference to FIGS. 8-10.

In some embodiments the outdoor units 108 are configured to receive input signals from an indoor unit, for example via an intermediate frequency (IF) cable, and convert the input signals to signals for transmission by the antenna system, for example radiofrequency signals. The outdoor units 108 are further configured to receive signals from the antenna as input, for example radiofrequency signals, and convert the received signals to signals for transmission to the indoor unit via the intermediate frequency cable.

In use, each outdoor unit transmits (or receives) a signal at an associated frequency. In the dual-band example shown in FIGS. 1*a* and 1*b*, a first outdoor unit transmits (or receives) signals in a first frequency band and a second outdoor unit transmits (or receives) signals in a second frequency band. For example, the first outdoor unit may transmit and/or receive signals in the 23 GHz frequency band, while the second outdoor unit may transmit and/or receive signals in the 80 GHz frequency band.

The signals at the first frequency band travel along a first signal path through the system. The signals at the second frequency band travel along a second signal path through the system. Transmitted signals are coupled to waveguides in the branch box 106 via the outdoor unit interfaces 110 associated with each outdoor unit 108. Each outdoor unit 108 is associated with at least one waveguide, through which signals from that outdoor unit 108 propagate.

The signals propagate through the branch box 106 to the polariser interface 112 using the waveguides. The polariser interface 112 couples the branch box 106 waveguides to the polariser device 104 such that the signal paths for the different frequency bands pass through the polariser device 104 and on to the reflector 102. The signal paths for the different frequency bands may pass via a feed source which illuminates the reflector 102.

The polariser device 104 acts to select and/or set the polarisation of signals passing through it. The polariser device 104 is configurable to select the polarisation of each frequency band independently. For example, the polariser device 104 may be configured to select signals in the first frequency band of a first polarisation, and select signals in the second frequency band of a second polarisation. The first and second polarisations may be the same, or they may be different. The polarisations may be linear polarisations, elliptical polarisations and/or circular polarisations.

The polarised signals pass from the polariser 104 to the reflector 102, where they are transmitted. Signals received at the reflector 102 pass through the system in the opposite direction, and polarisations may be selected by the polariser device 104 in a corresponding way.

An advantage of this set up is that the polarisation of any frequency band can be changed without having to remove both outdoor units 108, thereby allowing faster configuration of the polarisation settings of the antenna system 100. The polarisation configurations are set up using the polariser device 104 between the branching box 106 and the antenna 102, by only removing the branching box assembly. Once the polarisation settings have been configured, the system is fixed in the configured polarisation states during operation. The polarisations can be re-configured if/when different polarisation settings are required by removing the branch box 106 from the polariser and resetting the polariser device 102.

Figure 2:
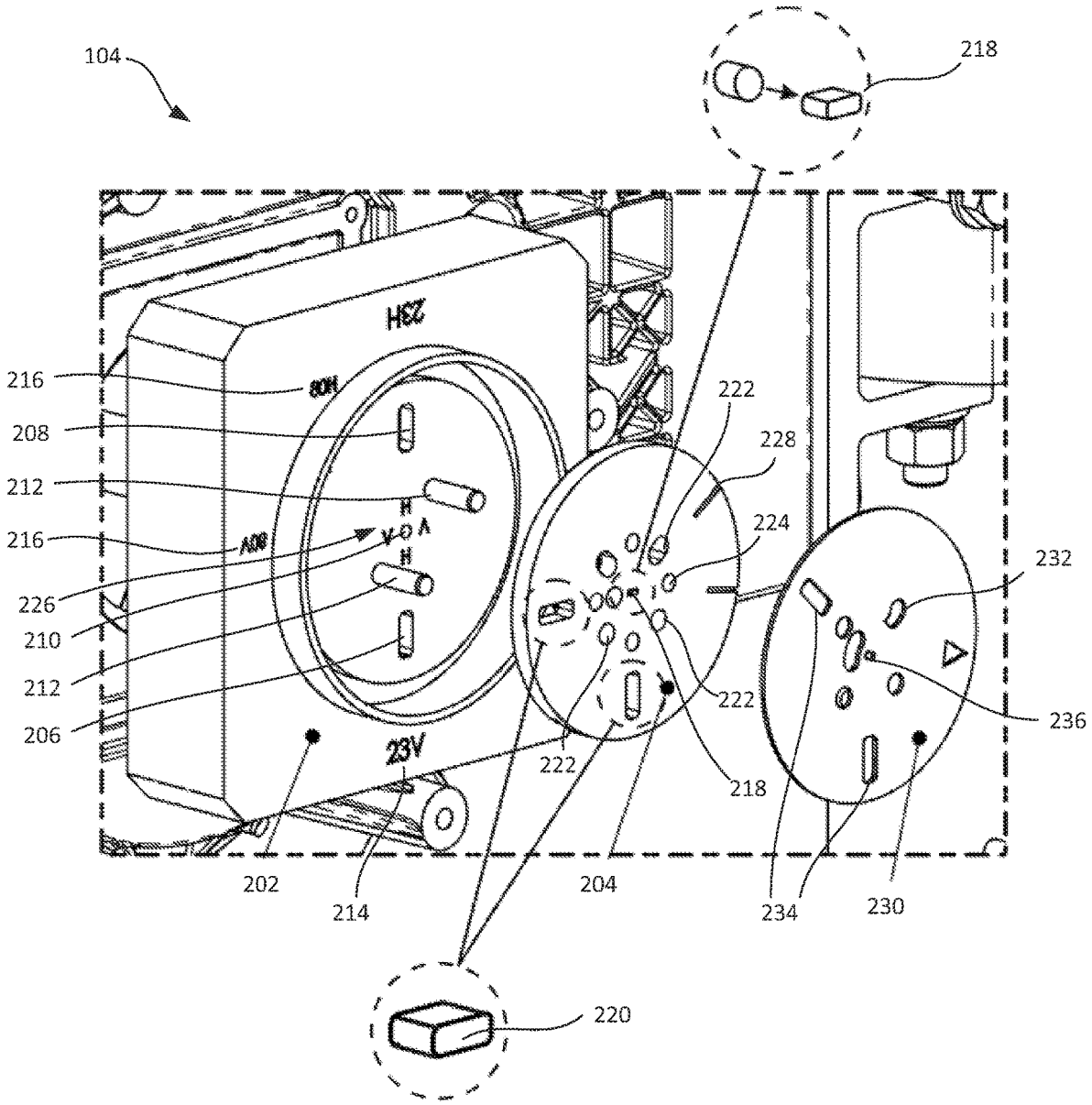
FIG. 2 shows an example embodiment of a polarisation device.

FIG. 2 shows a disassembled view of an example embodiment of a polariser device 104. The polariser device 104 comprises a first part 202 (herein also referred to as a "dual-band feeding system") and second, transition part 204 (herein also referred to as a "dual-band transition"). In the example shown, the first and second parts are geometrically co-axial. The first signal path (the signal path for signals at the first frequency) is offset from the central axis of the polariser device 104. The second signal path (the signal path for signals at the second frequency) runs along the central axis of the polariser device 104. However, other arrangements are possible.

Figure 3:
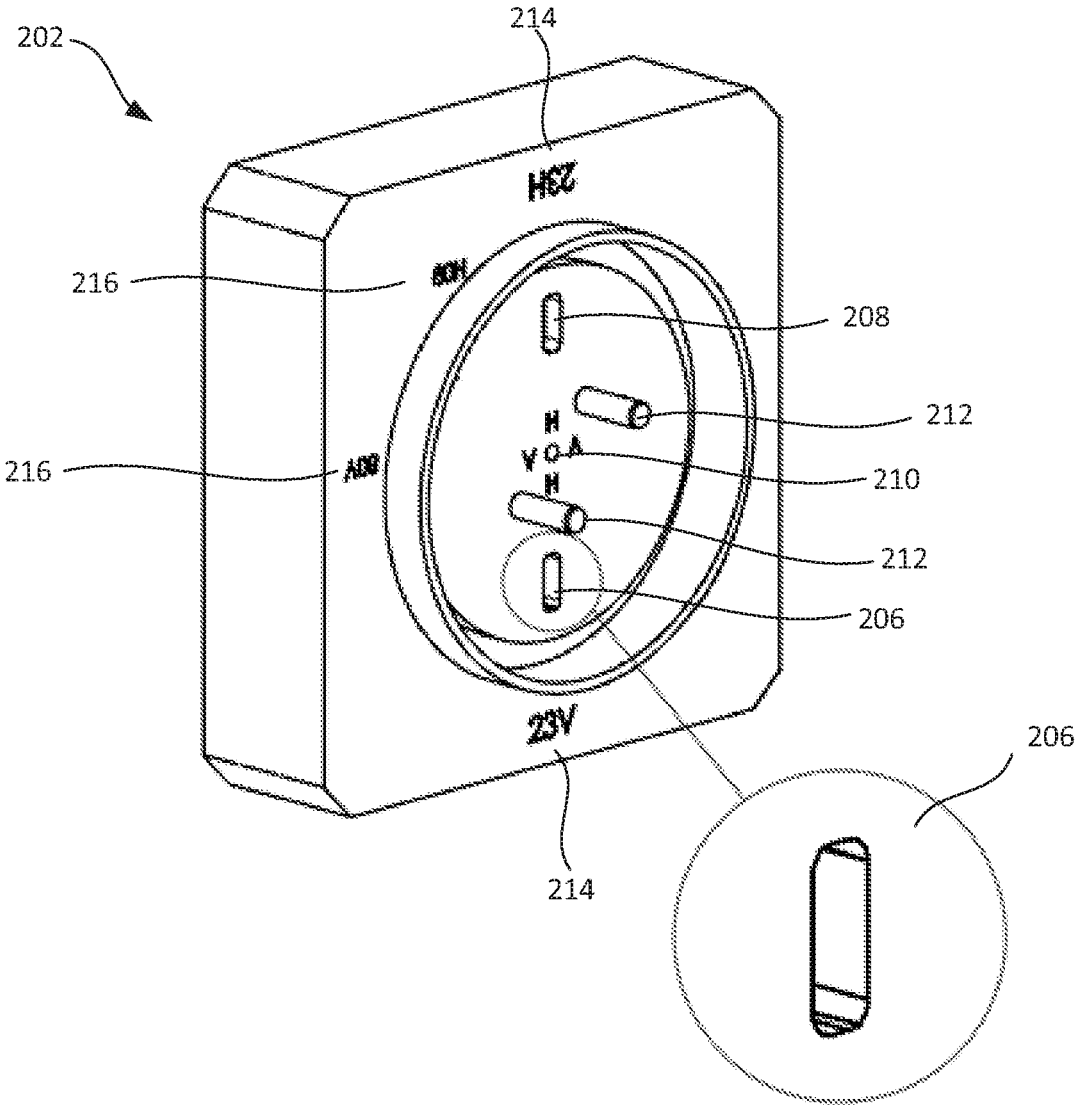
FIG. 3 shows an example embodiment of a first part of a polarisation device.

The first part 202 is shown in more detail in FIG. 3. The first part 202 comprises a first aperture 206 for a first propagation path and a second aperture 208 for a second propagation path. The first part 202 is rotatable between first and second positions. In the first position, the first aperture 206 is located in the first signal path. Signals at the first frequency propagate through the first part 202 via the first aperture 206, and are propagated through the first propagation path in a first polarisation state. In the second position, the second aperture 208 is located in the first signal path of the signals at the first frequency. Signals propagate through the first part 202 via a second aperture 208, and are propagated along the second propagation path in a second polarisation state. For example, the first polarisation state may be a vertically polarised state and the second polarisation state may be a horizontally polarised state. In general, the first and second polarisation states are orthogonal.

In some embodiments, the first part comprises an orthomode transducer for combining or separating two orthogonally polarised microwave signal paths.

Figure 4:
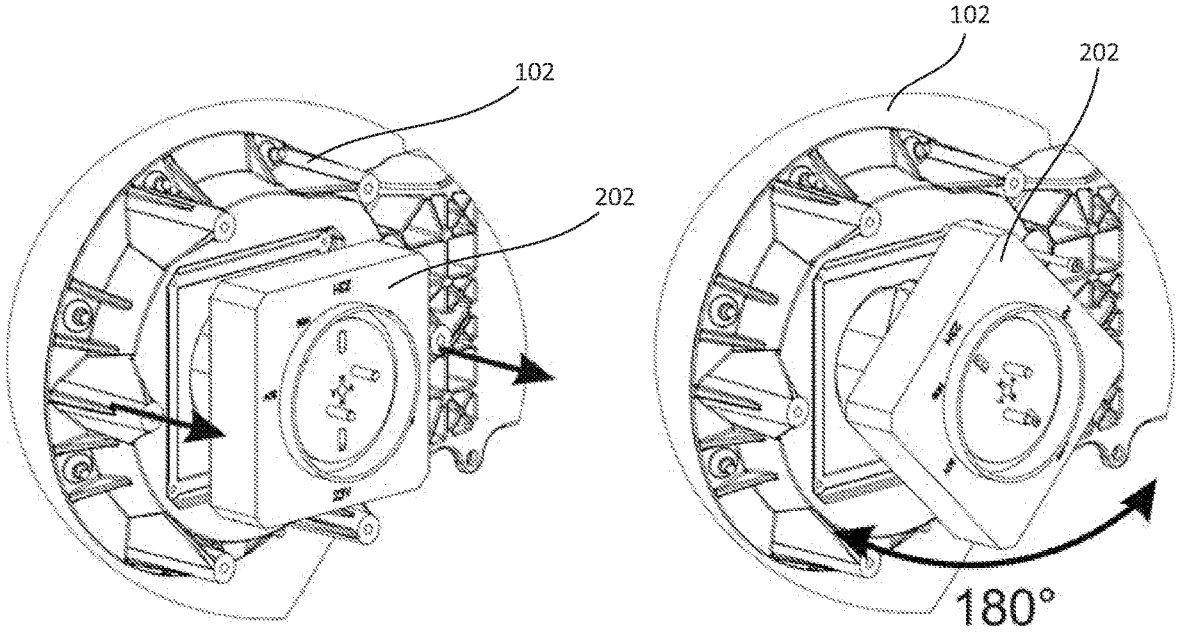
FIG. 4 shows an example embodiment of the first part of a polarisation device being configured.

In the example shown, the first aperture 206 and the second aperture 208 are located either side of a central axis of the first part 202. Rotating the first part 202 one-hundred and eighty degrees relative to the reflector 102 and branching box 106 therefore changes the polarisation state of the signals propagating along the first signal path. An example of this is shown in FIG. 4. The first part 202 is unscrewed from the back of the reflector 102 and then rotated one-hundred and eighty degrees before being fixed to the back of the reflector 102 again.

In some embodiments, there are only two possible positions for installing the dual band feeding system on the antenna, for example:

23V⇒23 GHz in V (vertical) polarisation setup

23H⇒23 GHz in H (horizontal) polarisation setup

In the embodiments shown, the 23 GHz waveguide is the bottom one and lines up with the waveguide of the branching box, which is fixed.

With reference again to FIG. 3, the first part 202 is further configured to allow propagation of signals in the second signal path in both of the first or second positions. For example, the second signal path may pass through an opening or waveguide 210 in the first part 202. The opening may be located at the central axis of the first part 202 such that, when the second signal path runs along the central axis of the polariser device 104, only a single opening is used for both orientations of the first part 202. However, in examples where the second signal path is offset from the central axis, a plurality of openings may be used. The opening may comprise a circular waveguide, a rectangular waveguide or a square waveguide.

In some embodiments, the first part 202 comprises one or more pins 212 for mounting and orienting the second part 204.

The first part 202 may further comprise labels for the first frequency polarisation state 214. The orientation of these labels 214 when the polariser device is assembled can be used to indicate which polarisation state the first part 202 will apply. For example, in the embodiment shown, the correctly oriented label at the bottom of the polariser device 104 can be used to indicate the polarisation state to be applied. In this example, it is the vertical polarisation state, indicated by the "23V" label.

The first part may further comprise labels for the second frequency polarisation state 216. One or more of these labels 216 will align with alignment markings 228 on the second part 202 to indicate the polarisation state that the second part 202 will apply.

The second part 204 comprises a transition element 218. The second part is rotatable between a first configuration and a second configuration. In the first configuration, the second part 204 is configured to selectively propagate signals at the second frequency in a first polarisation state. In the second configuration, the second part 204 is configured to selectively propagate signals at the second frequency in a second polarisation state.

Figure 5:
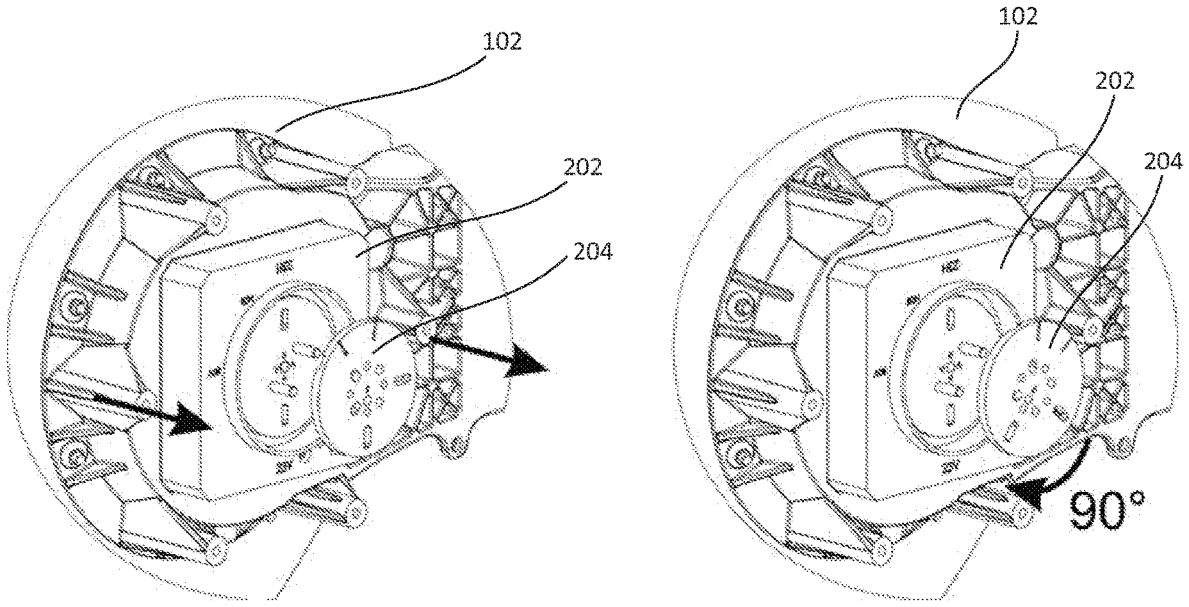
FIG. 5 shows an example embodiment of the second part of a polarisation device being configured.

The second configuration can be a ninety degree rotation of the second part 204 relative to the first configuration, as shown in FIG. 5.

The transition element 218 may also be configured to transition a waveguide shape in the second signal path to/from rectilinear signals from/to circular signals, as shown in the blown up view of the transition element 218 in FIG. 2. For example, the transition element 218 may convert $TE_{11}$ circular waveguide modes to $TE_{10}$ rectangular waveguide modes, or vice versa.

The transition element 218 is located in the second signal path. In the example shown, it is located at the central axis of the polarising device 104.

The second part is configured to allow propagation of signals in the first signal path in either the first or second configurations. In some embodiments, the second part 204 comprises a plurality of apertures 220. In the first configuration, signals travelling through the first signal path can propagate through at least one of the apertures. In the second configuration, signals travelling through the first signal path can propagate through at least another one of the apertures. The apertures 220 are located in the second part 204 such that at least one of the apertures 220 aligns with the aperture 206, 208 of the first part 202 that is in use.

In embodiments where the first part 202 comprises one or more mounting pins 212, the second part 204 comprises one or more corresponding mounting holes 222. The mounting pins 212 pass through at least some of the mounting holes 222 in order to secure the second part 204 to the first part 202 and ensure correct alignment between the first and second parts. In some embodiments, such as the one shown, the second part comprises more mounting holes 222 than the first part 202 has mounting pins 212 in order to facilitate rotation of the second part 204 relative to the first part 202. In the example shown, the second part has four mounting holes 222 arranged at ninety degrees relative to each other around the central axis. The first part 202 has two mounting pins 212 arranged at one-hundred and eighty degrees relative to each other around the central axis. This facilitates rotation of the second part 204 by ninety degrees relative to the first part 202.

The second part 204 may further comprise one or more viewing holes 224. One of the viewing holes 224 aligns with one of a plurality of polarisation state markings 226 on the first part 202 to allow a user to easily ascertain the polarisation state of the signals at the second frequency.

The second part 204 may further comprise one or more alignment markings 228. At least one of the alignment markings 228 lines up with at least one of the second polarisation state labels 216 on the first part 202 to indicate the polarisation state of the signals at the second frequency. This allows a user to easily ascertain the polarisation state of the signals at the second frequency.

In some embodiments, the polariser device 104 further comprises a waveguide rotator 230. The waveguide rotator 230 ensures correct alignment between the second frequency waveguide on the polariser interface 112 of the branch box 106 and the polarising element 218 on the second part 204. On the branching box 106, the polariser interface 112 second frequency waveguide is oriented at forty-five degrees. The polariser interface 112 second frequency waveguide is fixed in order to only manage the second frequency band polarisation with the assembled Dual band transition 204 & rotator 230.

Therefore, between the dual-band transition 204, which enables the second frequency polarisation change and the branching box 106, a waveguide rotator 230 is needed for correctly orienting the waveguide of the second signal path. The function of the waveguide rotator 230 is to change the orientation of the waveguide. The orientation of the waveguide rotator depends of the dual-band transition 204 setup (for example vertical or horizontal polarisation for the signals in the second frequency band). The waveguide rotator 230 is thus configured to orientate the polarisation of signals in the second signal path in order to couple the second signal path to an interface on the branching box 106.

In some embodiments, the waveguide rotator may be secured in the polarisation device 104 in the same way as the dual band transition 204, for using the mounting pins 212 of the dual band feeding system 202. The waveguide rotator comprises corresponding mounting holes 232.

The waveguide rotator 230 is rotatable between a first and a second orientation to orient the waveguide of the second signal path. In the example show, the waveguide rotator is rotatable between two positions that differ by one-hundred and thirty-five degrees around the central axis. A rotator element 236 is located in the second signal path that acts to rotate the waveguide, such that it is correctly orientated.

The waveguide rotator 230 comprises a plurality of apertures 234 for allowing propagation of signals in the first signal path through the waveguide rotator 230 in both the first and second orientations. For example, in the first orientation, at least one of the apertures 234 aligns with the first signal path. In the second position, at least one different aperture 234 aligns with the first signal path.

Figure 6A:
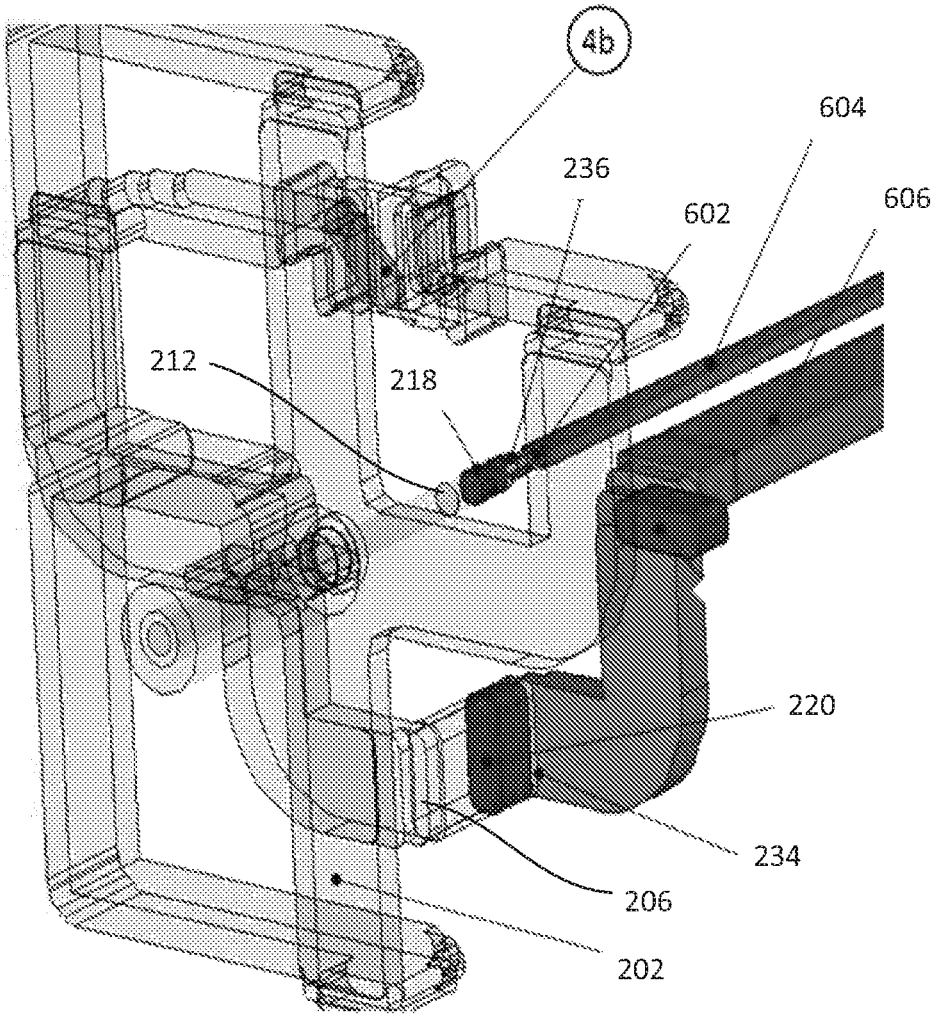
FIGS. 6*a* and 6*b* show cutaway views of an example embodiment assembled polarisation device.
Figure 6B:
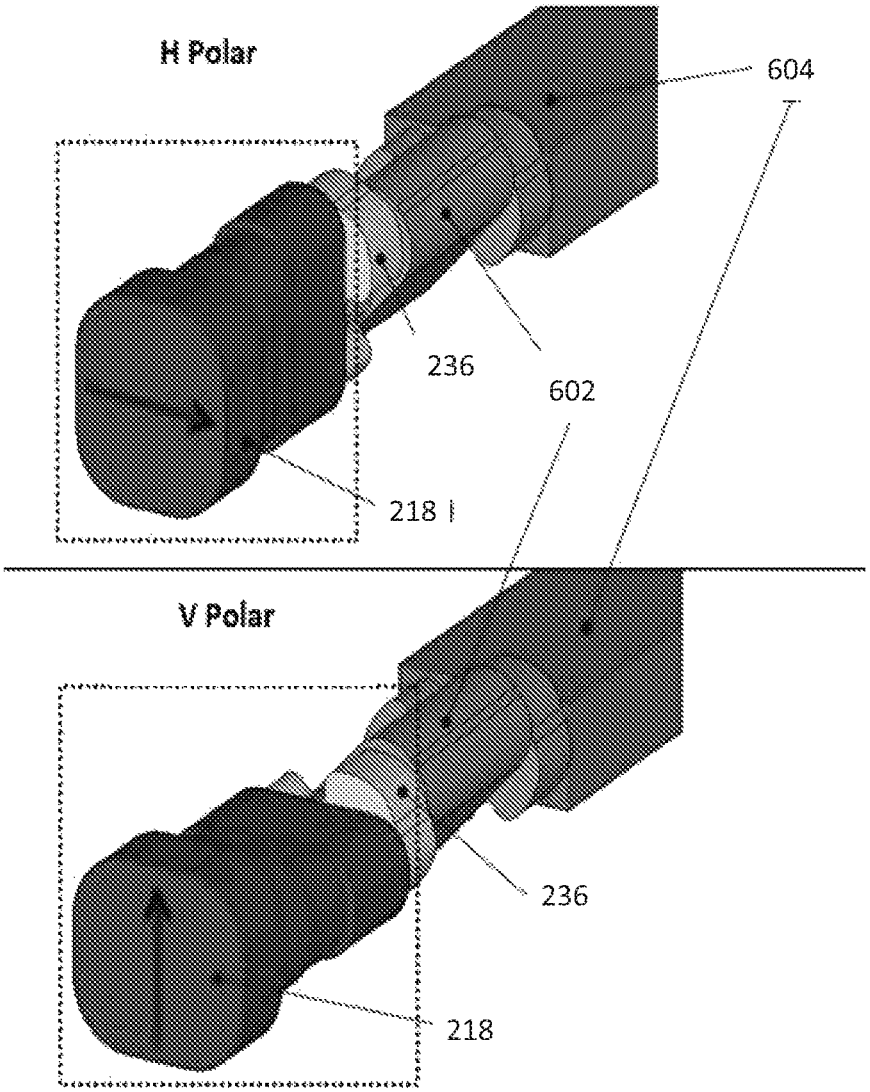

FIGS. 6*a* and 6*b* show a cutaway view of an example embodiment of an assembled polariser device. The branch box second frequency waveguide interface 602 is at a forty-five degree orientation. The rotator element 236 acts to rotate the waveguide to correctly align output of (or input to) the branch box 106 second frequency waveguide interface 602 with the polarising element 218 of the second part 204. This can be seen in FIG. 6*b*, where the rotator element 236 is in a different orientation depending on the second part 204 configuration. In a first rotator position, the waveguide rotator 230 aligns the waveguide of the polariser interface 112 with the transition part when the transition part has the horizontal polarisation selected. In a second rotator position, the waveguide rotator 230 aligns the waveguide of the polariser interface 112 with the transition part when the transition part has the vertical polarisation selected. In the example shown, the waveguide rotator is rotated by one-hundred and thirty-five degrees to change between the first and second rotator positions.

Figure 7A:
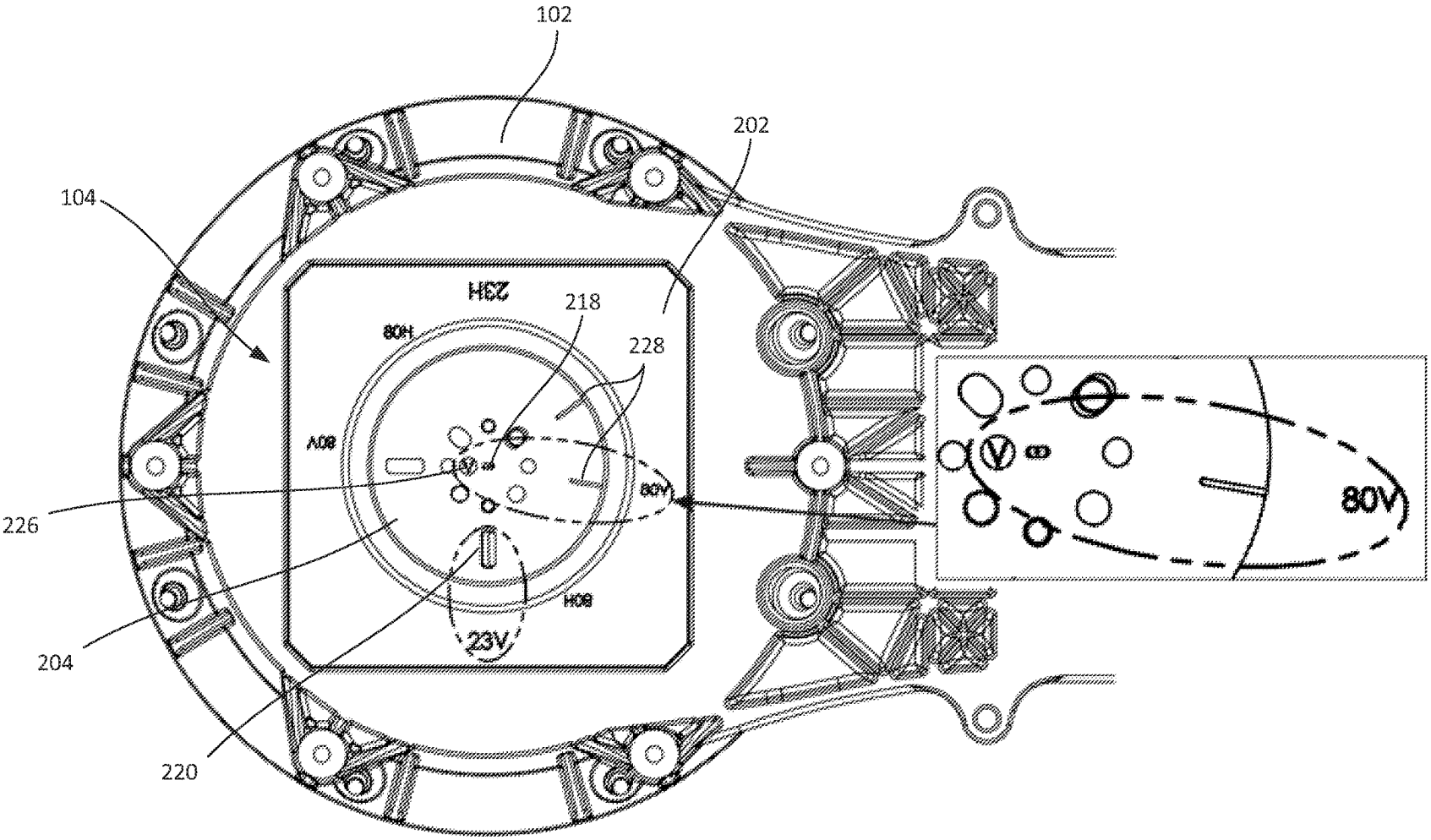
FIGS. 7*a-c* show examples of assembled polarisation devices attached to reflector dishes.
Figure 7B:
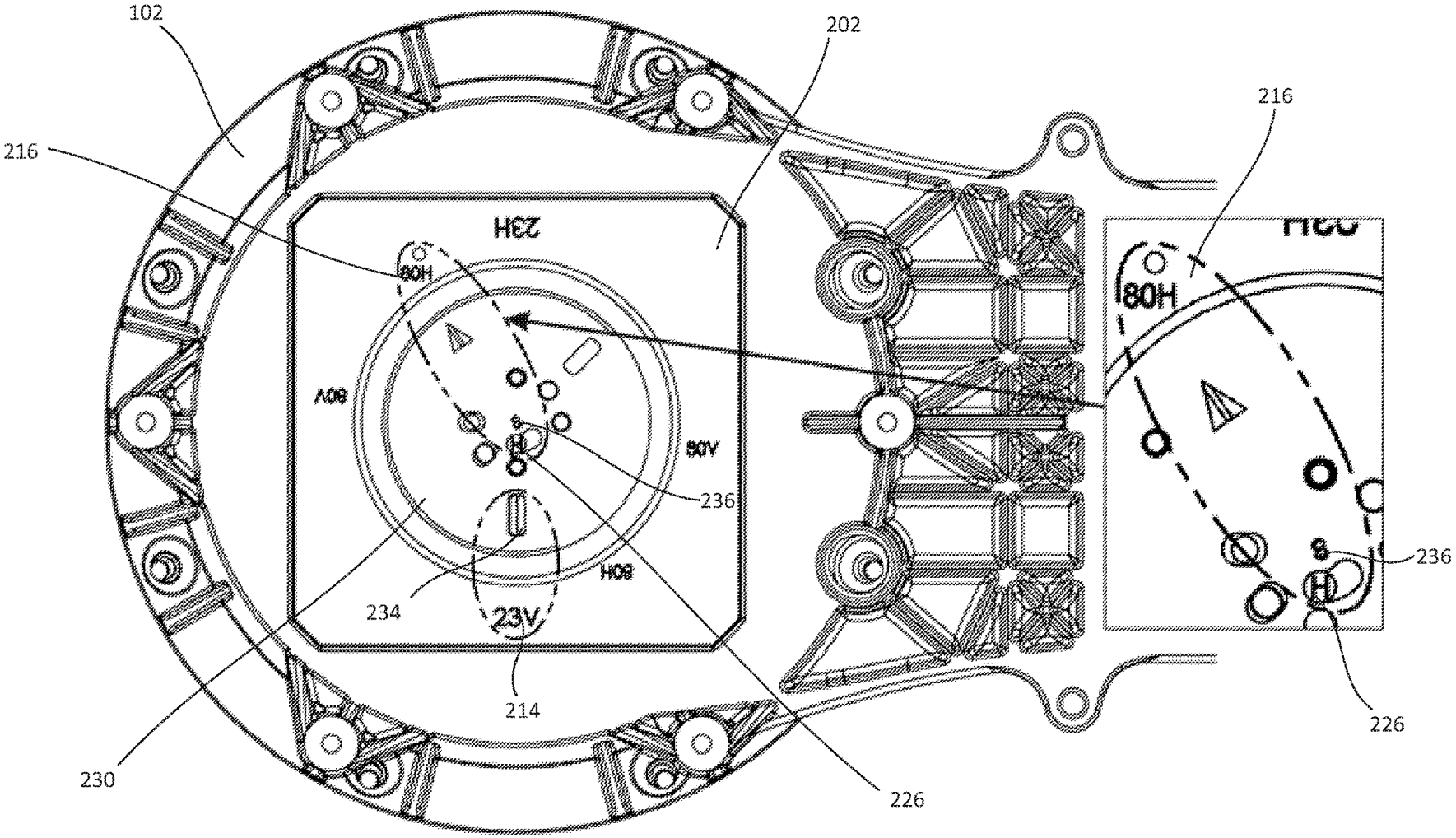
Figure 7C:
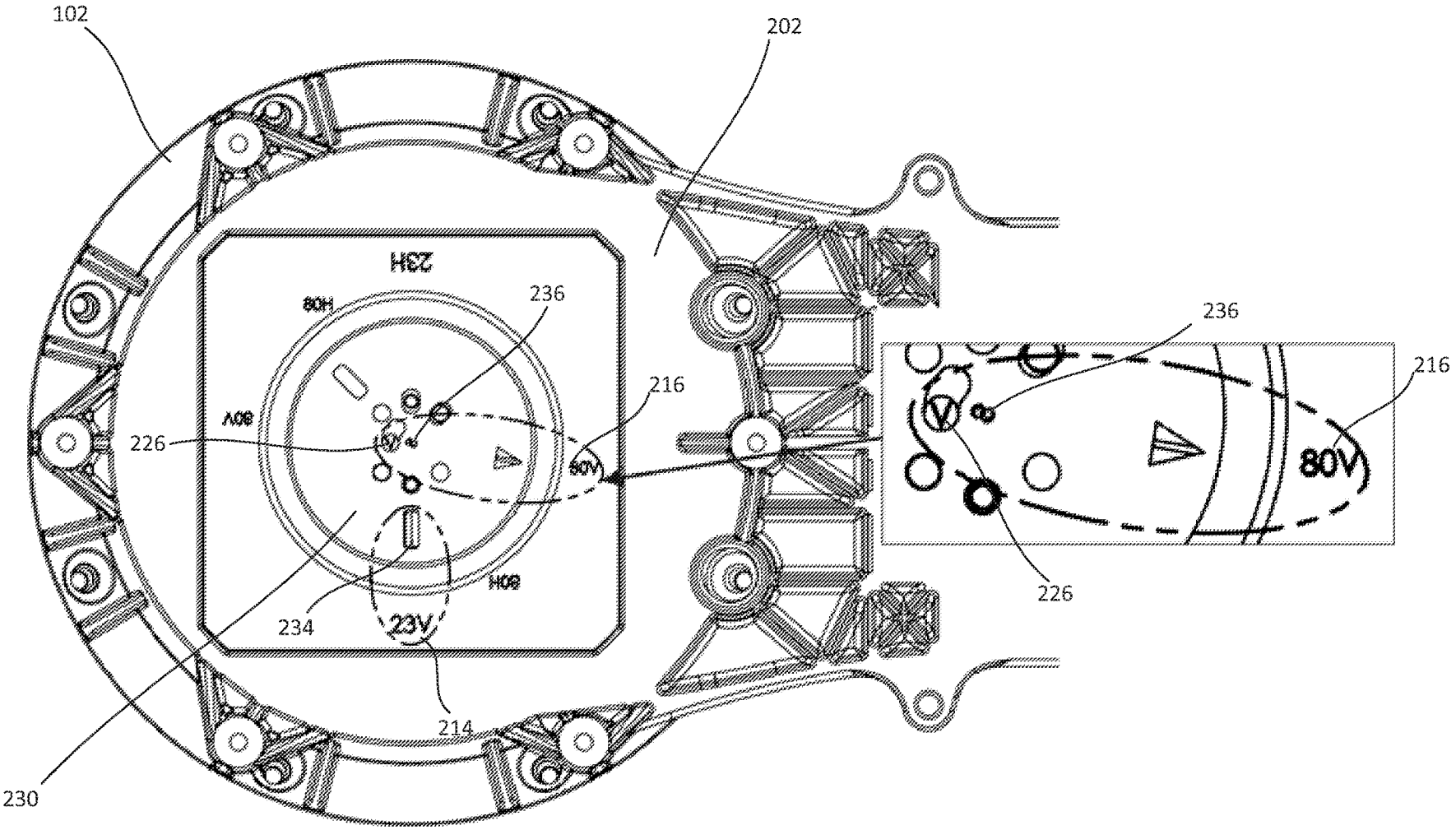

FIGS. 7*a-c* show plan views of examples of assembled and partially assembled polarisation devices attached to reflector dishes. The second signal path is oriented along the central axis of the polariser device 104. The first signal path is oriented along a path offset from and parallel to the central axis, which in the examples shown is along the lower part of the polariser device. The parts are labelled in the same way as FIGS. 1*a-b* and FIG. 2. In FIGS. 7*a* to 7*c*, the first frequency band polarisation is set to vertical (as indicated by the "23V" marking at the bottom of the first part 202).

In FIG. 7*a*, the waveguide rotator 230 is not present. An alignment marking 228 is aligned with the "80V" second polarisation marking 216, indicating that the second frequency signals will be polarised by the second prat 204 into a vertical polarisation state.

In FIGS. 7*b* and 7*c*, the waveguide rotator 230 is present. In FIG. 7*b*, the second part is configured to polarise the signals at the second frequency into a horizontal polarisation state. This is indicated by the arrow on the waveguide rotator 230 pointing to the "80H" marking on the first part 202. It is also indicated by the "H" marking on the first part 202 being visible through the openings on the second part 202 and waveguide rotator 230. In FIG. 7*c*, the second part is configured to polarise the signals at the second frequency into a vertical polarisation state. This is indicated by the arrow on the waveguide rotator 230 pointing to the "80V" marking on the first part 202. It is also indicated by the "V" marking on the first part 202 being visible through the openings on the second part 202 and waveguide rotator 230.

Figure 8:
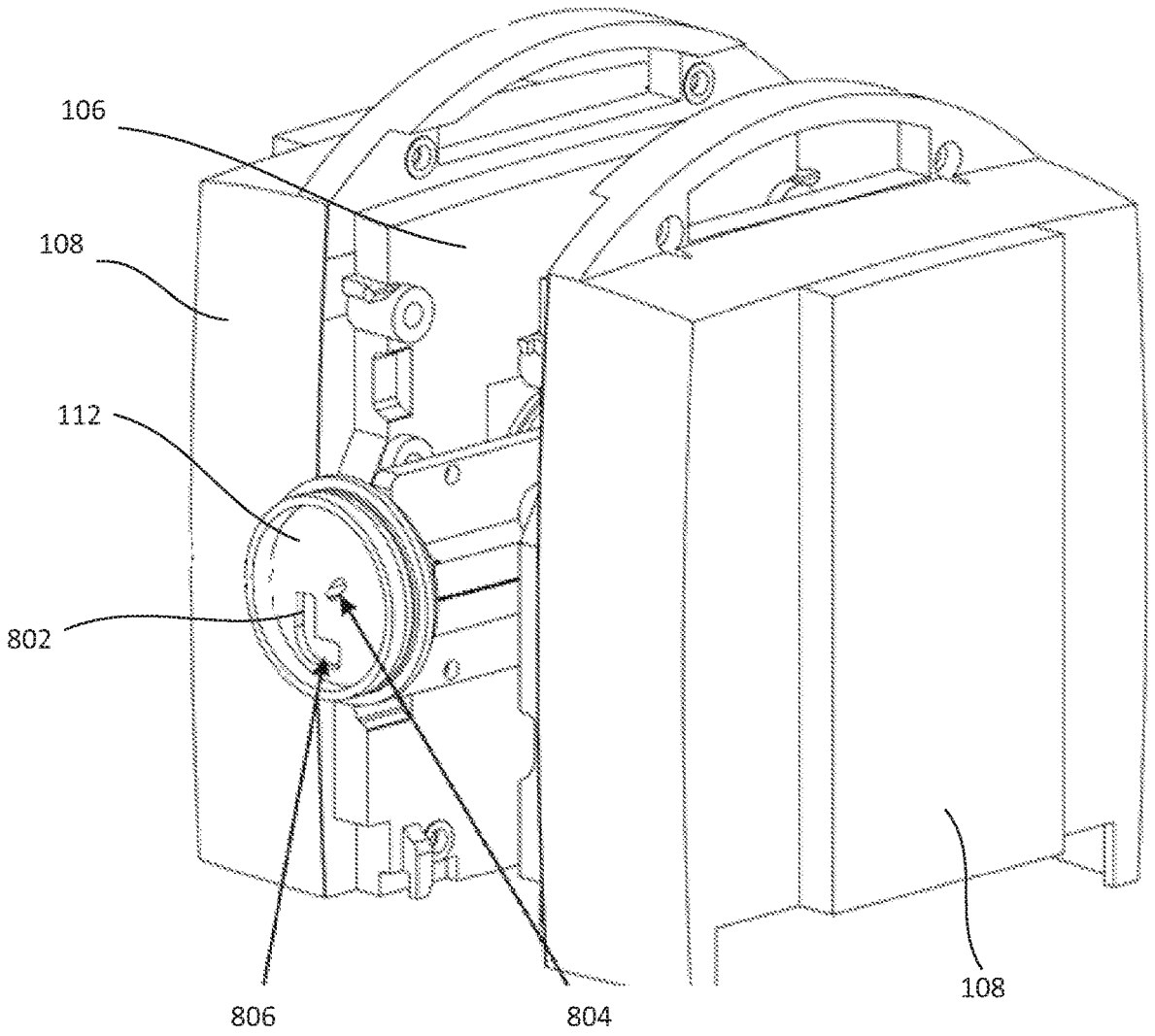
FIG. 8 shows a perspective view of an example embodiment of a branch box.

FIG. 8 shows a perspective view of an example embodiment of a branch box and outdoor units. FIGS. 9*a* and 9*b* shows a plan view of an example embodiment of a branch box and outdoor units. FIG. 10 shows a close-up view of an example embodiment of a polariser interface of a branch box. Each outdoor unit 108 is connected to the branch box via an outdoor unit interface 110, via which the outdoor units can transmit and/or receive signal to/from the branch box 106. Each outdoor unit interface 110 is associated with a respective waveguide 802, 804, which guides the signals from the outdoor unit interfaces no to the polariser interface 112 of the branch box 106.

Signals at the first frequency propagate through a first waveguide 802. The first waveguide 802 ends in an L-shape element 806. In order to remain in the horizontal plane machining of the dual band branching box shells and thus to simplify the manufacturing, a right angle waveguide bend is performed to align the first waveguide with the first frequency band access of the antenna. The other advantage to use a right angle is to reduce the width of the dual band branching box. For instance in 23 GHz, the width is reduced to 8 mm.

Signals at the first frequency propagate through a second waveguide 804. The second waveguide is oriented at forty-five degrees at the polariser interface 112.

Figure 11:
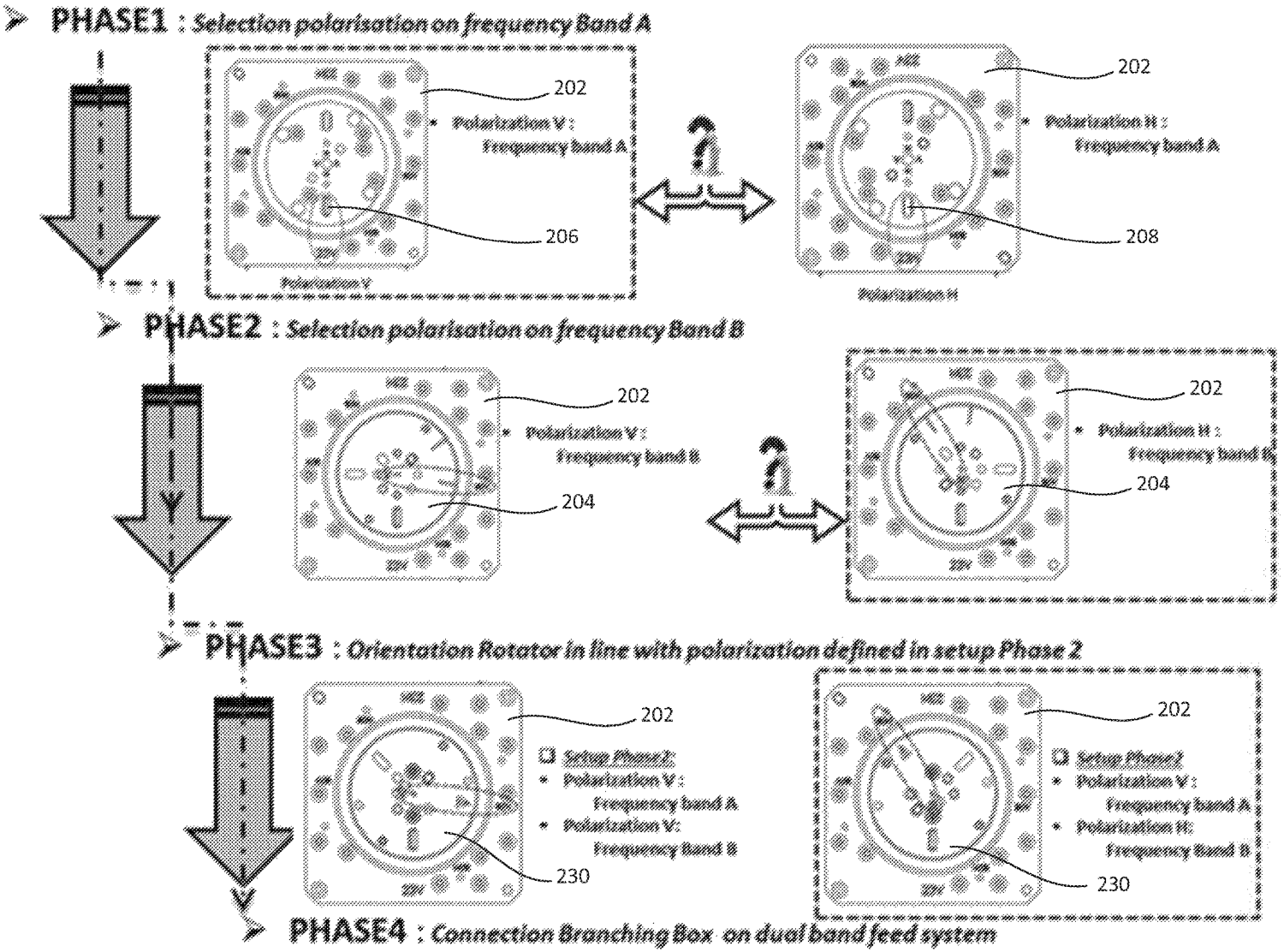
FIG. 11 shows an example embodiment of a polarisation device being configured.

FIG. 11 shows an example embodiment of a polarisation device being configured. In phase one, an orientation of the first part 202 is selected to provide a desired polarisation of the signals in the first frequency band. In the example shown, the vertical polarisation state is selected by orienting the first part such that the first aperture 206 is aligned with the first signal path. In this case the first signal path runs through the lower part of the polariser device 104. The first part is fixed to the reflector 102 in the chosen orientation.

In phase two, the dual-band feeding system 202 (i.e. the first part) is set up, the dual-band transition 204 (i.e. the second part) is installed on it. The mounting pins 212 on the dual band feeding system 202 are used to line the dual-band transition 204 up correctly. The function of the dual band transition is to select the polarisation of the signals in the second frequency band (80 GHz for example) which propagate along the second signal path.

There are two alignment markings 228 on the dual-band transition 204 which are used to be line up with the second frequency polarisation state labels 218 (in this example the 80V or 80H labels) on the dual band feeding system 202. For example, being in line with the 80H mark means that the dual band transition 204 will act to polarise signals in the second frequency band in the horizontal direction. If one of the transition marks is in line with the 80V mark of the dual band feeding system 202, it means that the dual band transition 204 will act to polarise signals in the second frequency band in the vertical direction. In the example shown, a horizontal polarisation has been selected for the signals in the second frequency band.

In addition to these second frequency polarisation state labels 218, there may also be polarisation state markings 226 near the dual-band feeding system 202 central axis, close to the second signal path. The polarisation state markings 226 can be seen through the dual-band transition 204 through at least one viewing hole 224. This double check can reduce mistakes by a user.

In phase three, the waveguide rotator 230 is set up. To assist installing the rotator in the right position given by the transition installation, there is a cut-out which aligns with corresponding second frequency polarisation state labels 218 on the dual-band feeding system 202. Another double check can be performed beside, for example, the 80 GHz location, in order to be sure that the V or H mark is still visible. The whole assembly can be fixed with two screws before plugging it into the branching box assembly.

The assembly configuration of the above described three parts (first part/dual-band feeding system, second part/dual-band transition, and the waveguide rotator) allows the polarisation of each frequency band to be selected independently. Following this method, there are four possible setups for the polariser device 102:

TABLE 01

Feasible polarisation's configurations on Dual band antenna

| Dual Band antenna | Frequency band A | Frequency band B |
|---|---|---|
| Configuration 01 | Polar H | Polar V |
| Configuration 02 | Polar H | Polar H |
| Configuration 03 | Polar V | Polar H |
| Configuration 04 | Polar V | Polar V |

Figure 12A:
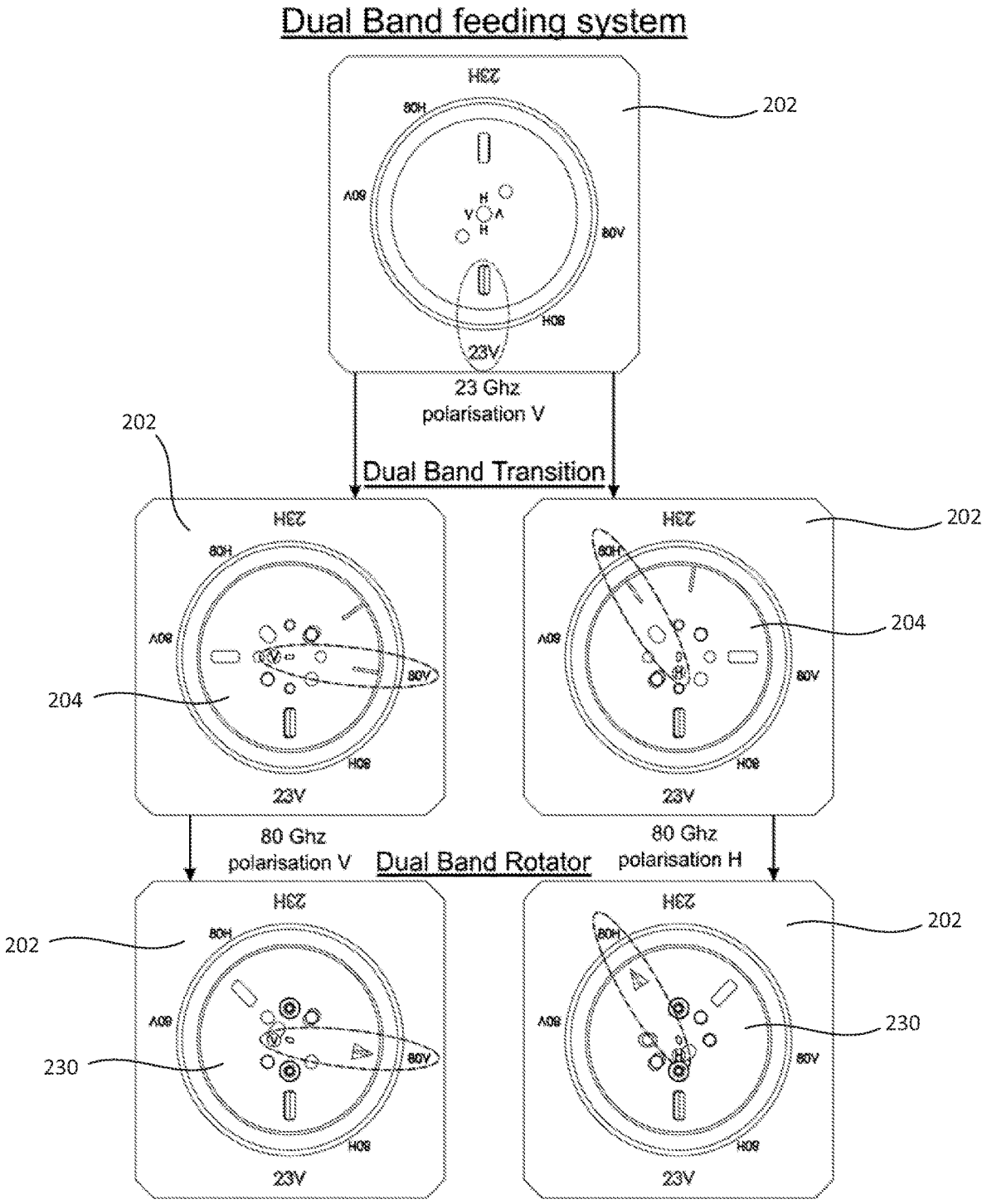
FIGS. 12*a* and 12*b* show schematic diagrams of example methods of configuring a polarisation device.
Figure 12B:
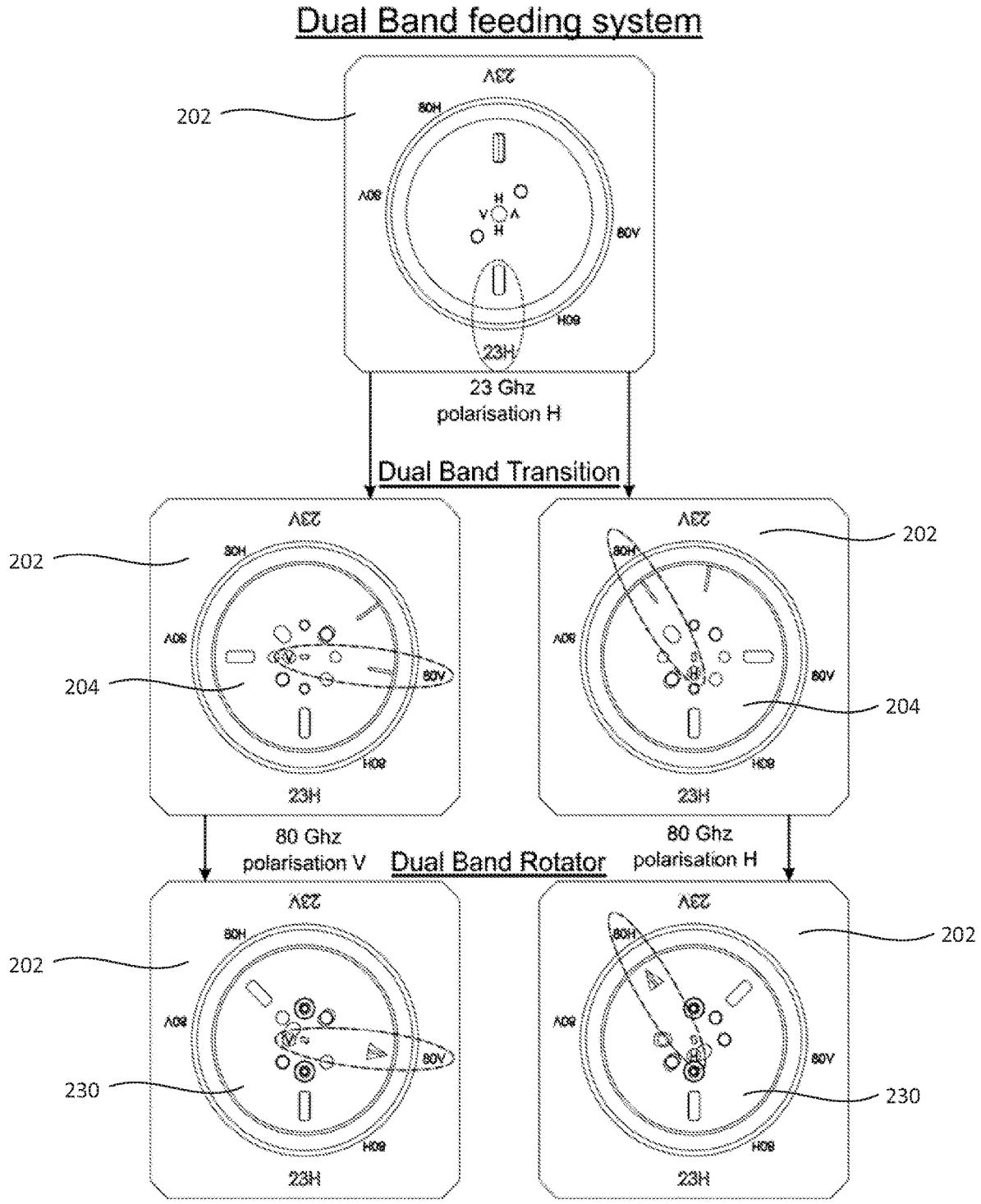

FIGS. 12*a* and 12*b* show schematic diagrams of example methods of configuring a polarisation device in each of the four polarisation configurations, using the method described in relation to FIG. 7.

Figure 13:
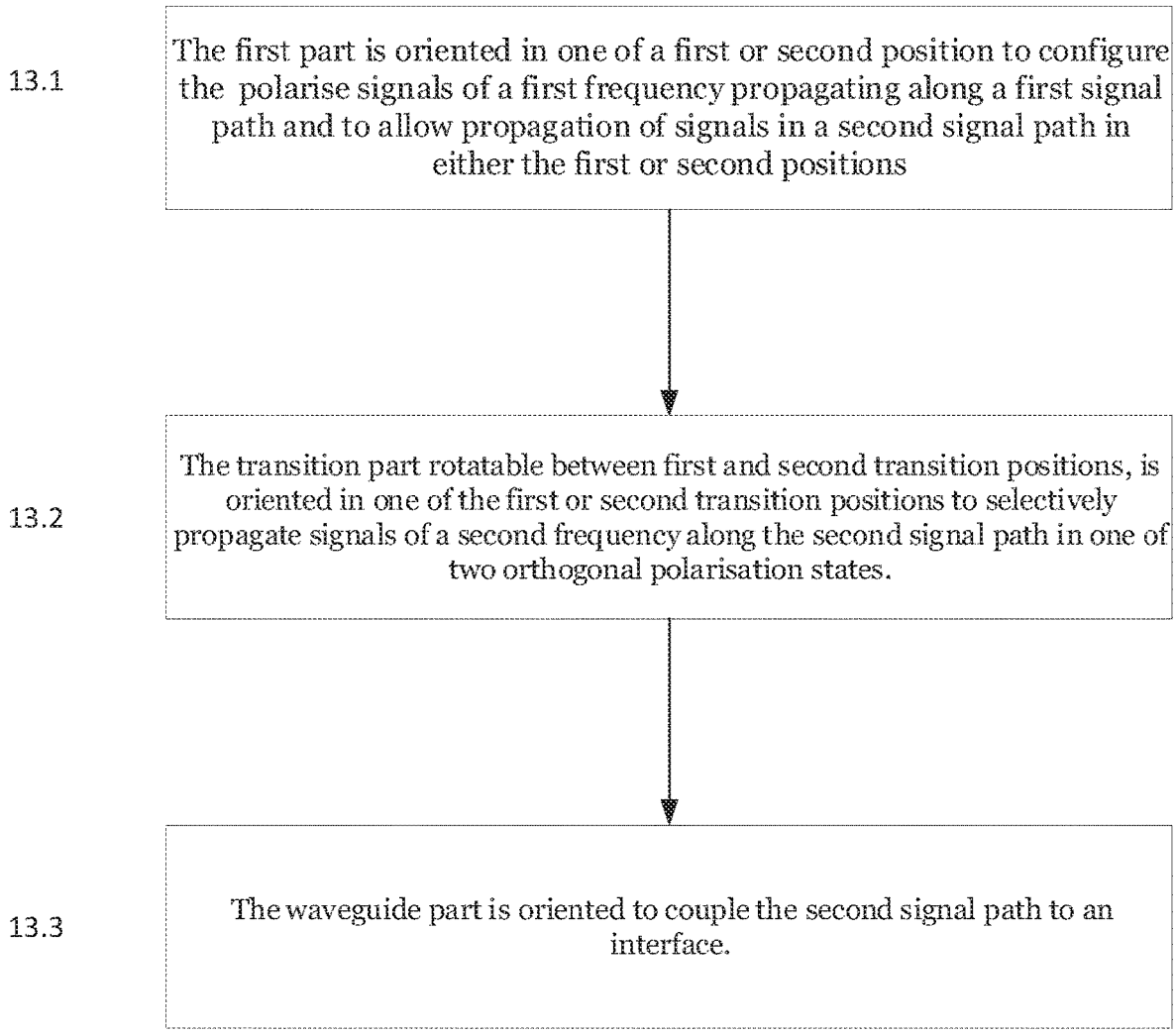
FIG. 13 shows a flow diagram of an example method of configuring a polarisation device.

FIG. 13 shows a flow diagram of an example method of configuring a polarisation device. At operation 13.1, the first part 202 is oriented in one of a first or second position to configure the polarisation of signals of a first frequency propagating along a first signal path and to allow propagation of signals in a second signal path in either the first or second positions. The first frequency polarisation can, for example, be selected by orienting the first part 202 in one of two positions that differ by one-hundred and eighty degrees. The orientation of the first part can be achieved as described above in relation to FIGS. 11 and 12.

At operation 13.2, the second part 204 rotatable between first and second transition positions is oriented in one of the first or second transition positions to selectively propagate signals of a second frequency along the second signal path in one of two orthogonal polarisation states. The second frequency polarisation can, for example, be selected by orienting the second part 204 in one of two positions that differ by ninety degrees. Alignment markings 228 on the second part 204 can be used to ensure the correct position for the desired polarisation is used. The orientation of the second part can be achieved as described above in relation to FIGS. 11 and 12.

At operation 13.3, the waveguide rotator 230 is oriented to couple the second signal path to an interface. The waveguide rotator is oriented to align the transition element 218 with the second signal path waveguide 604 on the branch box 106. This can be achieved as described above in relation to FIGS. 11 and 12.

As used in this application, the term 'circuitry' refers to all of the following: (a) hardware-only circuit implementations (such as implementations in only analogue and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

If desired, the different functions discussed herein may be performed in a different order and/or concurrently with each other. Furthermore, if desired, one or more of the above-described functions may be optional or may be combined. Similarly, it will also be appreciated that methods described in relation to FIGS. 7-9 are examples only and that various operations depicted therein may be omitted, reordered and or combined.

Although various aspects of the invention are set out in the independent claims, other aspects of the invention comprise other combinations of features from the described embodiments and/or the dependent claims with the features of the independent claims, and not solely the combinations explicitly set out in the claims.

The invention claimed is:

1. An apparatus comprising:

a first part comprising first and second propagation paths configured to selectively propagate signals of a first frequency with either a first polarisation state or a second polarisation state, the first part being rotatable by 180 degrees between a first feed position in which the first propagation path is disposed within a first signal path and a second feed position in which the second propagation path is disposed within the first signal path, and wherein the first part is configured to allow propagation of signals in a second signal path in either the first or second feed positions;

a transition part rotatable by 90 degrees between first and second transition positions, wherein the transition part is configured to selectively propagate signals of a second frequency along the second signal path with the first polarisation state when in the first transition position and with the second polarisation state when in the second transition position, wherein the transition part is configured to allow propagation of signals in the first signal path in either the first or second transition positions; and, a rotator part rotatable by 135 degrees between first and second rotator positions, the rotator part being configured to orientate the polarisation of signals in the second signal path in order to couple the second signal path to an interface, wherein the rotator part is configured to allow propagation of signals in the first signal path in either the first or second rotator positions, wherein the first part, transition part and rotator part are coaxial and wherein the second signal path is oriented along an axial path and the first signal path is offset from the axial path.

2. The apparatus of claim 1, wherein the first and second polarisation states are orthogonal relative to one another.

3. The apparatus according to claim 1, wherein the first part comprises an orthomode transducer.

4. The apparatus according to claim 1, wherein the first part comprises one or more mounting pins, and wherein the transition part is configured to be mounted on the one or more pins.

5. The apparatus according to claim 1, wherein the first part comprises one or more labels indicative of a polarisation setting and wherein the transition part further comprises one or more openings arranged to align with at least one of the labels.

6. The apparatus of claim 1, wherein the transition part further comprises one or more alignment markings for orienting the transition part relative to the first part.

7. A system comprising a first part comprising first and second propagation paths configured to selectively propagate signals of a first frequency with either a first polarisation state or a second polarisation state, the first part being rotatable by 180 degrees between a first feed position in which the first propagation path is disposed within a first signal path and a second feed position in which the second propagation path is disposed within the first signal path, and wherein the first part is configured to allow propagation of signals in a second signal path in either the first or second feed positions;

a transition part rotatable by 90 degrees between first and second transition positions, wherein the transition part is configured to selectively propagate signals of a second frequency along the second signal path with the first polarisation state when in the first transition position and with the second polarisation state when in the second transition position, wherein the transition part is configured to allow propagation of signals in the first signal path in either the first or second transition positions;

a rotator part rotatable by 135 degrees between first and second rotator positions, the rotator part being configured to orientate the polarisation of signals in the second signal path in order to couple the second signal path to an interface, wherein the rotator part is configured to allow propagation of signals in the first signal path in either the first or second rotator positions, wherein the first part, transition part and rotator part are coaxial and wherein the second signal path is oriented along an axial path and the first signal path is offset from the axial path;

a first radio unit configured to transmit and/or receive microwave signals at the first frequency;

a second radio unit configured to transmit and/or receive microwave signals at the second frequency different to the first frequency; and a waveguide element operable to couple the second radio unit to the second signal path via the interface, and the first signal path to the first radio unit via a further interface.

8. The system according to claim 7, further comprising a reflector coupled to the first and second signal paths.

9. A communications tower comprising:

a first part comprising first and second propagation paths configured to selectively propagate signals of a first frequency with either a first polarisation state or a second polarisation state, the first part being rotatable by 180 degrees between a first feed position in which the first propagation path is disposed within a first signal path and a second feed position in which the second propagation path is disposed within the first signal path, and wherein the first part is configured to allow propagation of signals in a second signal path in either the first or second feed positions;

a transition part rotatable by 90 degrees between first and second transition positions, wherein the transition part is configured to selectively propagate signals of a second frequency along the second signal path with the first polarisation state when in the first transition position and with the second polarisation state when in the second transition position, wherein the transition part is configured to allow propagation of signals in the first signal path in either the first or second transition positions;

a rotator part rotatable by 135 degrees between first and second rotator positions, the rotator part being configured to orientate the polarisation of signals in the second signal path in order to couple the second signal path to an interface, wherein the rotator part is configured to allow propagation of signals in the first signal path in either the first or second rotator positions, wherein the first part, transition part and rotator part are coaxial and wherein the second signal path is oriented along an axial path and the first signal path is offset from the axial path;

a first radio unit configured to transmit and/or receive microwave signals at the first frequency;

a second radio unit configured to transmit and/or receive microwave signals at the second frequency different to the first frequency; and a waveguide element operable to couple the second radio unit to the second signal path via the interface, and the first signal path to the first radio unit via a further interface.

10. The communications tower according to claim 9, further comprising a reflector coupled to the first and second signal paths.

* * * * *